US009311890B2

(12) United States Patent
Morovic et al.

(10) Patent No.: US 9,311,890 B2
(45) Date of Patent: Apr. 12, 2016

(54) ASSIGNING DISPLAY COLORS TO ACHIEVE APPARENT DESIRED COLORS

(71) Applicant: Hewlett-Packard Development Company, L.P., Houston, TX (US)

(72) Inventors: Jan Morovic, Colchester (GB); Peter Morovic, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 326 days.

(21) Appl. No.: 14/016,513

(22) Filed: Sep. 3, 2013

(65) Prior Publication Data

US 2015/0062148 A1 Mar. 5, 2015

(51) Int. Cl.
*G09G 5/06* (2006.01)
*G09G 5/02* (2006.01)

(52) U.S. Cl.
CPC .. *G09G 5/06* (2013.01); *G09G 5/02* (2013.01); *G09G 2320/0285* (2013.01); *G09G 2340/0428* (2013.01); *G09G 2340/06* (2013.01)

(58) Field of Classification Search
CPC ..... G09G 5/06
See application file for complete search history.

(56) References Cited

U.S. PATENT DOCUMENTS

| | | | | |
|---|---|---|---|---|
| 5,748,858 | A | 5/1998 | Ohtsuka et al. | |
| 8,213,055 | B2 | 7/2012 | Morovic et al. | |
| 2002/0005960 | A1* | 1/2002 | Yada | G06K 15/00 358/1.1 |
| 2003/0038953 | A1* | 2/2003 | Damera-Venkata | H04N 1/52 358/1.9 |
| 2010/0214576 | A1* | 8/2010 | Morovic | H04N 1/6016 358/1.9 |
| 2012/0013635 | A1 | 1/2012 | Beeman et al. | |
| 2012/0086721 | A1* | 4/2012 | Morovic | H04N 1/00015 345/589 |
| 2012/0262475 | A1* | 10/2012 | Frank | G09G 5/02 345/597 |

FOREIGN PATENT DOCUMENTS

CN 101047865 A 10/2007

* cited by examiner

*Primary Examiner* — James A Thompson
*Assistant Examiner* — Tapas Mazumder
(74) *Attorney, Agent, or Firm* — Hewlett-Packard Patent Dept.

(57) ABSTRACT

A system in accordance with an example is to assign a display color to a pixel to be displayed, to achieve an apparent desired color at a local neighborhood node of pixels having an apparent color bit depth greater than an addressable color palette for the display color that the pixel is capable of producing. The display color is assigned to the pixel based on a convex combination of colors of the local neighborhood node of pixels, to provide the desired color for the node based on local optical averaging.

14 Claims, 7 Drawing Sheets

ASSIGNING DISPLAY COLORS TO ACHIEVE APPARENT DESIRED COLORS

BACKGROUND

Low-color-bit-depth displays, e.g., as used on the backs of airline seats, for large indoor signage, and so on, may provide affordable display capability. However, the low number of available colors inhibits the ability to provide realistic colors at each display pixel.

BRIEF DESCRIPTION OF THE DRAWINGS/FIGURES

DETAILED DESCRIPTION

A low-color-bit-depth display may display a reduced set of colors (e.g., 256, or even 16 distinct colors) compared to a desired source content input, in contrast to a high-quality display having a large color gamut (e.g., 10 bits per channel control, millions of addressable colors, etc.). Techniques may be used to transform the higher-bit-depth source content to be displayed on the limited color palette of the display, such as dithering to spatially diffuse incurred color errors between input and output. Such dithering solutions tend to implicitly select a particular dithered solution for a given desired input, without considering many potential dithered alternatives for the desired input. Therefore, use of dithering in many cases may not result in a least-noisy or most energy efficient dithered alternative that potentially is possible for a given display and usage scenario. The potential alternative approaches to provide a desired color on a given display may depend on how the display is used, such as viewing distance.

Examples provided herein may apply Halftone Area Neugebauer Separation (HANS) to various color dithering approaches for displays, using the display's addressable colors in place of Neugebauer Primaries. HANS can enable a direct and explicit optimization of color pattern properties, and can involve a consideration of many color pattern alternatives to arrive at a desired dithering selection that exhibits desired characteristics. Examples may use per-color optimized choices for dithering display patterns. Additionally, patterns even may be formed using colors that are nowhere near each other in a color space, unlike existing display driving solutions that are typically limited to their native color channels and may dither using similar choices across all colors.

As a result, examples provided herein can deliver greater image quality and/or other output attributes of displays having a limited color palette, as well as high-quality displays, e.g., in situations where the input color depth exceeds a color depth of the display. Advantages include providing access to a full set of possible display patterns for each source color, providing direct optimization of desired attributes (noise, energy, etc.), obtaining increased performance from low-cost hardware for applications like point of sale, in-flight entertainment systems, etc., and providing print-like control over high-resolution displays for signage and other displays.

Figure 1:
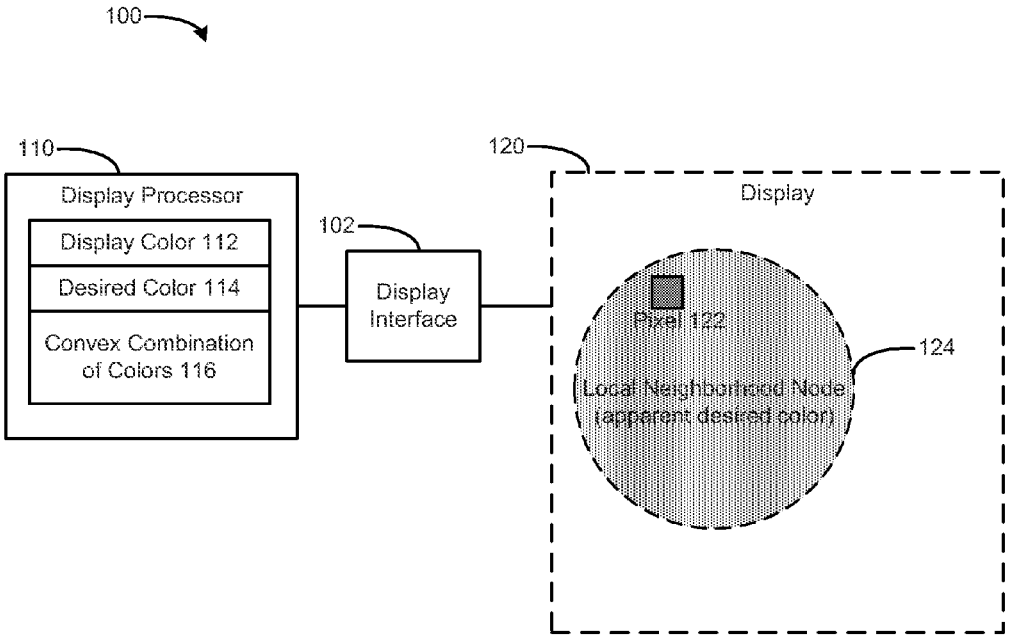
FIG. 1 is a block diagram of a display system including a display processor according to an example.

FIG. 1 is a block diagram of a display system 100 including a display processor 110 according to an example. The display processor 110 is coupled to a display 120 via a display interface 102, to assign a color to a pixel 122 to be displayed. The display processor 110 is to operate based on the display color 112, desired color 114, and convex combination of colors 116, to provide an apparent desired color at a local neighborhood node 124.

The display processor 110 provides a way of deciding what colors are to be displayed at individual pixels 122, so that when viewed at a normal distance, the desired apparent output is provided. System 100 is shown including hardware, although in alternate examples, embodiments may take the form of a computer program or other software/hardware (graphics driver software, graphics card hardware) that can drive and/or interface with a display 120. Additionally, examples may be provided as part of a display 120 itself, having a display processor 110 in the display 120, wherein the display 120 is coupleable to a source (graphics card) to receive and convert standard color inputs. In an example, a low bit depth display 120 may include a display processor 110 to interface with a high bit depth input source.

In general, the display processor 110 may drive the display 120 based on, e.g., sending color inputs on three color channels of red, green, blue (RGB). The display processor 110 may make some adjustments to these inputs to take into account the constant characteristics and/or constraints of the display 120. For lower bit displays 120, such as those having less than 8-bits per channel, the display processor 110 may change neighboring pixels, based on the input to the particular pixel 122 directly. Thus, examples may take advantage of the ability of the human visual system (HVS) to look at the display 120 to see each individual pixel 122, as well as a merging of some local neighborhoods 124 within the display 120. Thus, examples may use dithering techniques to provide the appearance of more variety than the display 120 strictly is capable of, while considering many different alternatives to provide a given desired color 114.

The display 120 may be limited to fewer addressable colors capable of being displayed at a pixel 122 (e.g., limited to 16-colors, 256-colors, and so on), compared to a source content that is to be output, which may have a greater variety of colors (e.g., 16.8 million colors etc.). This enables the display processor 110 to consider a very large number of alternative spatial patterns that would achieve a desired color 114. The alternative spatial patterns may be composed of varying relative area coverages of the limited addressable colors (display colors 112), that match a given desired color 114 from among the greater source variety when seen from a suitable distance (at which distance the spatial pattern may be optically summed or otherwise affected by the viewer's HVS). Accordingly, the display processor 110 may access this potential space of solutions including potentially many alternative spatial patterns, and make choices that best meet the needs of the display application in view of constraints and usages of the display 120.

Display 120 may be an RGB display, and also may include other displays such as those based on cyan, magenta, yellow (CMY) pixels, or other displays that use additional colors beyond three (e.g., on top of RGB, CMY, or other colors), including any combination of sub-pixel colors. Regardless of particular display colors 112 used, the display processor 110 may take measurements of addressable colors of a display 120, and may use those addressable colors and whatever resources are available at a given display 120, whether it be a combination of RGB and/or other colors. Thus, examples provided herein are not limited to RGB displays. The display processor 110 is to display pixels 122 based at least in part on local neighborhood nodes 124.

Display interface 102 may be hardware and/or software. In an example, the display interface 102 is an internal hardware coupling within a display housing the display processor 110 (e.g., traces on a circuit board etc.). Alternatively, the display interface 102 may be a standard connector for a graphics card, based on a removable cable to couple the display processor 110 to the display 120. In an example, the display interface 102 may be a software driver to enable the display processor 110 to operatively communicate with a display 120.

The display processor 110 may be hardware or software, including a discrete hardware graphics processor, and/or a software module executable by a central processing unit (CPU) or other processor to drive a display 120.

A local neighborhood node 124 may be considered when assigning display colors 112 to various pixels 122 within that node 124. A local neighborhood node 124 may include one or more pixels 122, and is shown for illustrative purposes including an arbitrary number of pixels 122. The display processor 110 may operate within the display's color planes (e.g., the red green and blue for an RGB display) and develop combinations of display colors 112 from individual pixels 122. Given the expected usage (such as viewing distance), a certain number of display pixels can be expected to be optically integrated by a viewer's human visual system (e.g., a 2×2 pixel region, 3×3 pixel region, and so on, which may be treated as a local neighborhood node 124). This allows for the pixels below that integration threshold to be assigned colors from among the limited addressable palette of the display 120. Thus, to produce yellow in an example local neighborhood node 124, half of the addressable area on an RGB display 120 may be set to full red, and half to full green, resulting in the additive yellow color in the local neighborhood node 124.

In an example, the desired color 114 to be presented may correspond to a particular red (or other color) that is not available among the display colors 112 that the display 120 is capable of displaying (e.g., not within an addressable color palette of the display 120). Accordingly, the display processor 110 may color one or more of the pixels 122 in the local neighborhood node 124 using one of various similar reds that are among the displayable display colors 112. Other pixels 122 in the local neighborhood node 124 may be displayed using display color reds near but non-matching to the red of the desired color 114. Thus, the display processor 110 may distribute to a suitably sized local neighborhood node 124 any such differences, or errors, incurred due to the constraints of the display 120 (or other components, characteristics, and/or limitations of a display system), by determining combinations of alternative display colors 112 near to the desired color 114. The combination of such colors then may be averaged, e.g., by the HVS based on an intended viewing distance, to arrive at an apparent desired color on the display 120. Accordingly, the size of the local neighborhood node 124 may correspond to various factors including intended use/viewing distance, differences between display colors and desired colors, a size in number of pixels to be covered by the desired color 114, and so on.

However, in addition to the use of nearest alternative display colors 112, examples provided herein may further consider other alternative display colors, even those that are not near to the desired color 114 (e.g., combining reds and greens to achieve yellow). Examples may combine any of the displayable colors 112, to be mixed to result in the desired colors 114. In an example, the local neighborhood node 124 may be sized to complement the alternative display colors chosen to arrive at the desired color 114, resulting in an apparent desired color in the local neighborhood node 124. Accordingly, returning to the example of displaying a particular red, in addition to the option of using similar red displayable colors described above, examples provided herein also may involve display colors 112 for pixels 122 from other parts of the color space (i.e., non-red). Such choices may take into consideration the size of the local neighborhood node 124 and/or the intended usage of the display 120 including a viewing distance where the HVS would not typically be capable of resolving individual pixels 122. Examples described herein thus may take advantage of local optical averaging (a response by the HVS when at or beyond a viewing distance for the capability of resolving individual pixels 122). Thus, many options are available for the display processor 110 to mix colors on display 120, even for low bit depth displays 120.

Such apparent desired colors in a local neighborhood node 124 may arise based on color mixing according to a convex combination of colors 116, with weights that corresponded to the local prominence of component colors. More specifically, the weights may correspond to the barycentric coordinates of the desired color in the polyhedron formed by the component colors in the CIE XYZ color space. The convex combination of colors 116 also may be based on the viewer's HVS not being able to resolve individual display pixels 122, resulting in the appearance of the convex combination of local colors and expanding all the possible colors that a display 120 can render beyond merely the displayable individual pixel colors. Individual colors are combined based on additive convex optical mixing.

The display processor 110 may determine what relative area coverage is occupied by possible states of the display 120, such as intensity of output in color (e.g., RGB) channels of a display. By knowing relative area coverages and color states present, the display processor 110 may determine the resulting apparent color as a weighted sum of these elements, where the weights are the relative area coverages, thereby producing a convex combination. The elements may be convexly summed as a result of the visual acuity and other characteristics associated with the human visual system.

Convex combinations of colors 116 may be based on the display processor 110 determining optical sums of constituent color building blocks, which may be referred to as the Neugebauer primaries. For a display 120 having n pixel colors (e.g., n=3 for an RGB display), and the ability of k levels of brightness for each of the n colors, there are $k^n$ such Neugebauer primaries. Given an input desired color 114, the display processor 110 may evaluate the combinations of the $k^n$ primaries at different area coverages, yielding a set of alternatives that are a good match for that desired color 114. In other words, the display processor 110 is not limited to a single selection corresponding to approximating a given desired color 114. The display processor 110 also may consider intended use of the display 120, and other factors, and evaluate the set of alternatives in terms of relevant properties associated with each (e.g., grain, color constancy, power use, and so on). In view of the varying relevance assigned to the properties, the display processor 110 may determine an alternative color to be used for displaying the desired color 114. In an example, the display 120 may be signage in a store, where viewing distance is greater and power efficiency is more desirable. The display processor 110 may choose an alternative to maximize power efficiency while still arriving at the apparent desired color 114 (given the flexibility of having a greater viewing distance). For example, a desired color 114 of dark red may be achieved based on not illuminating 50% of the pixels to save power and provide a dark color (that might appear as grainy black/red if viewed up close). In an alternate example, the display may be used on the back of a passenger seat, where viewing distance is reduced but power savings is less important. Thus, the display processor 110 may determine that in such an intended usage scenario, the desired color 114 dark red is to be displayed based on illuminating the pixels (i.e., without causing 50% of the pixels to go dark) to provide an alternative red that is apparently equivalent to the earlier example, but under quite different display conditions. For example, using a mixture of light red and purple to arrive at the desired dark red while illuminating more pixels and achieving a smoother image for close-up viewing, without a need to use a lot of black. Accordingly, the display processor 110 has greater flexibility for achieving a desired color 114 based on the convex combination of colors 116, in view of various alternatives and intended display usage.

Figure 2:
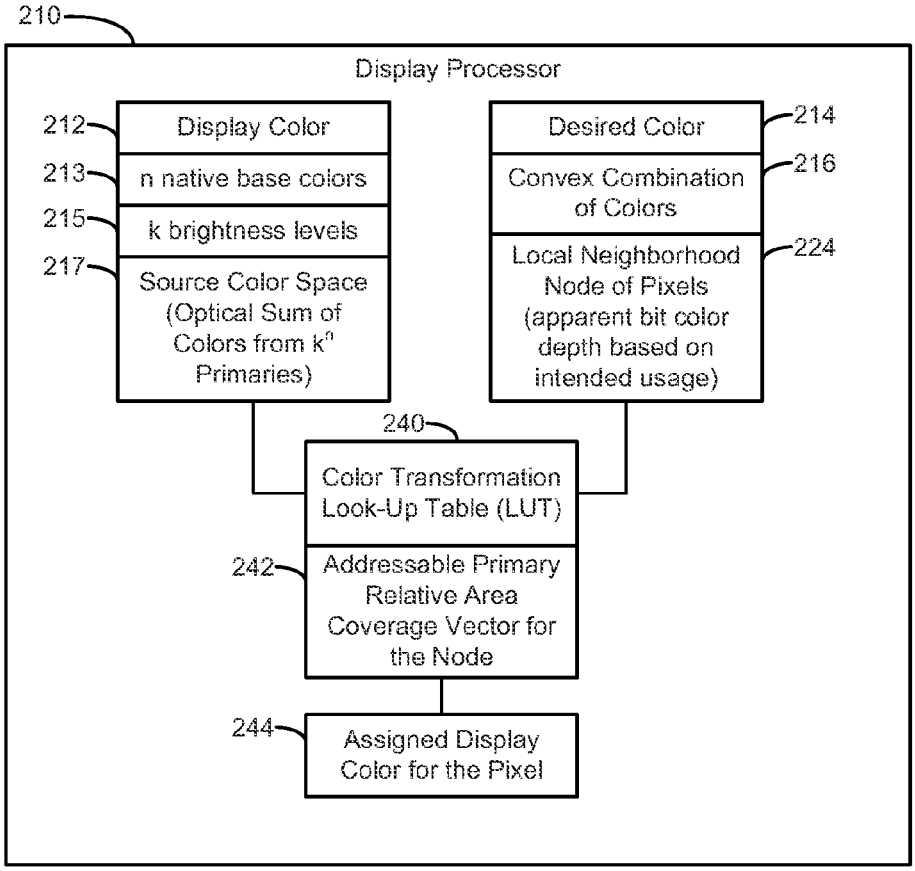
FIG. 2 is a block diagram of a display processor according to an example.

FIG. 2 is a block diagram of a display processor 210 according to an example. The display processor 210 is to determine an assigned display color for a pixel 244 based on, e.g., color transformation look-up table (LUT) 240. The LUT 240 may be based on an addressable primary relative area coverage vector for a node 242. The display processor 210 may operate based on display color 212, n native base colors 213, k brightness levels 215, source color space 217 (e.g., an optical sum of colors from $k^n$ primaries), desired color 214, convex combination of colors 216, local neighborhood node of pixels 224 (e.g., apparent color bit depth based on intended usage), and other metrics. The display processor 210 may use the various techniques and components as described above with reference to FIG. 1.

The LUT 240 may be used by the display processor 210 to assign colors to be displayed on a display, to produce a desired apparent color in view of the limitations of the display. The display processor 210 may set up the LUT 240 for routing colors based on the following technique, for example.

First, the display processor 210 may measure the display's addressable colors (which may be referred to as the addressable primaries). The addressable colors may be expressed according to the International Commission on Illumination (CIE) XYZ values, e.g., according to a chromaticity diagram. These measurements may be stored for future use, or may be pre-provided to the display processor 210, such that it is not necessary to perform this task each time the display processor is to route colors via the LUT 240. The LUT 240 may be populated with values expressed as vectors expressing the color routing for a given input to an output.

Next, for a sampling of an input space for the desired color 214 (e.g., a $9^3$ or $17^3$ sampling of sRGB, NTSC or PAL color space), the display processor 210 may determine convex combinations 216 of the addressable display colors 212 determined above, whose alternative combinations are considered to be a match to the desired color 214. This can be done using techniques as set forth above. Additionally, the display processor 210 may determine matching alternative combinations by traversing polyhedra that can be formed by the colors of the primaries, and looking for alternatives that are inclusions in the polyhedra.

The above techniques enable the display processor 210 to obtain a set of color pattern specifications, i.e., addressable primaries and a set of relative area coverages for them, which may be expressed as a vector. For example, the vector [1,2,3]=[0.5,0.4,0.1] would specify half an area (0.5) covered with addressable primary number 1, 40% (0.4) with addressable primary number 2, and 10% (0.1) with addressable primary number 3. The display processor 210 may select from such vectors 242 populating the LUT 240, based on relevant and/or weighted attributes and/or factors (such as intended display usage). For example, the LUT 240 may be used to identify a display pattern exhibiting the least optical noise or consuming the least energy for a given desired color 214. The LUT 240 may be indexed in source color space, e.g., its RGB value, that for each local neighborhood node 224 contains the addressable primary relative area coverage vector 242 chosen during the optimization process. Thus, the desired color 214 may be apparent based on the assigned display color 244 for the pixels.

The display processor 210 may initially populate the LUT 240 based on one determination in view of the characteristics of a given type of display. In other words, the display processor 210 does not need to determine a LUT 240 each time a pixel is to be displayed, nor does it need to re-calculate the LUT 240 multiple times. The LUT 240 may be an indication of the characteristics of a given display, which typically remain constant over time, as would the values in the corresponding LUT 240 remain constant. However, in alternate examples, a display may include characteristics that change over time. For example, a display based on organic light emitting diodes (OLED) may include displayable colors that degrade differently from each other in brightness over time/usage (e.g., blue may wear out faster than red or green). Accordingly, the display processor 210 may recalculate a LUT 240 to reflect changes to the characteristics of the display, e.g., to compensate for variations that may develop over time such as color degradation. Alternatively, the LUT 240 may be recalibrated based on a change in intended usage of the display. For example, the display processor 210 may alter the LUT 240 when a display is used at different viewing distances, or under different environments (such as a hot/humid environment vs. a cold arid environment) that might affect the perception by the HVS of the display, as well as situations that may affect the operational characteristics of the display themselves.

To apply the LUT 240, the display processor 210 may use error diffusion. For example, a non-zero addressable primary may be used for the first pixel, and the resulting error in addressable primary space may be diffused to neighboring pixels (e.g., using a dithering technique such as Floyd-Steinberg or other techniques). Alternatively and/or in addition, a threshold matrix approach may be used to address differences between the chosen addressable display color 212 and the desired color 214 that will arise in a local neighborhood 224 based on intended usage/viewing distance.

Figure 3:
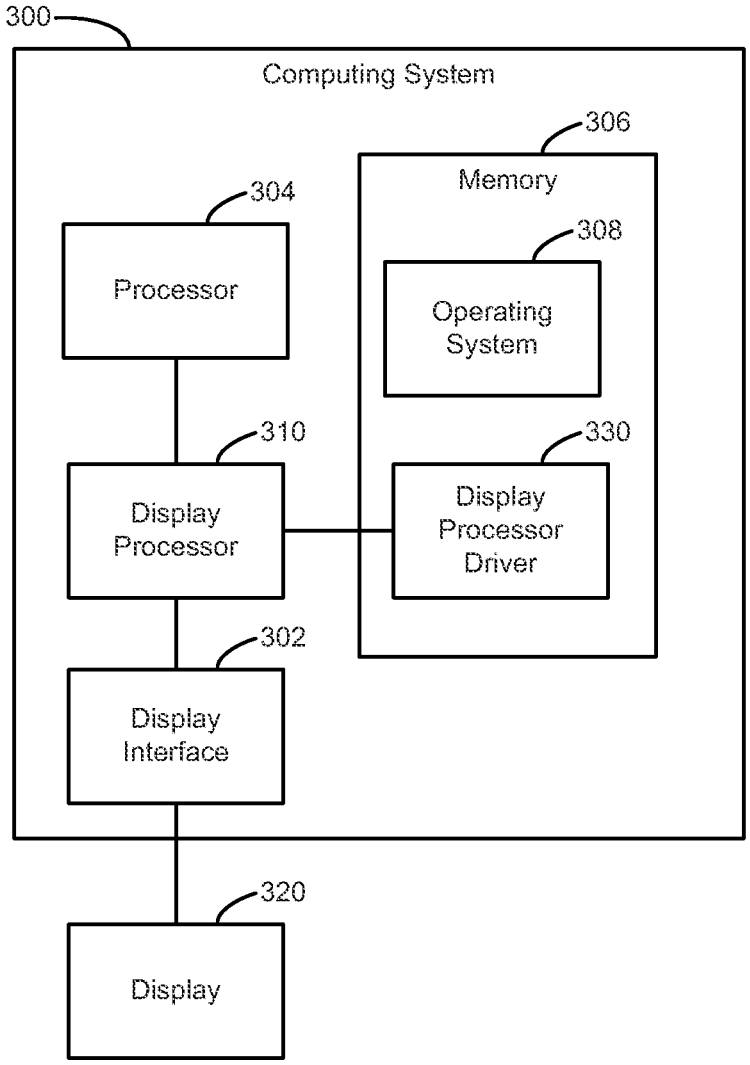
FIG. 3 is a block diagram of a computing system including a display processor and display processor driver according to an example.

FIG. 3 is a block diagram of a computing system 300 including a display processor 310 and display processor driver 330 according to an example. The computing system 300 also may include a processor 304 (e.g., a CPU), memory 306, and display interface 302. The memory 306 of computing system 300 may be associated with operating system 308, as well as the display processor driver 330. The display processor 310 may interface with the display 320 based on display interface 302. The display 320 may be a physical hardware display, and also may include virtualized displays.

In an example, the display processor driver 330 may direct the display processor 310 to assign display colors to pixels to be displayed on the display 320 via the display interface 302. Thus, the display processor driver 330 may enable a general-purpose graphics card (including a graphics processor 310 such as a graphics processing unit (GPU)) to provide the benefits described herein.

Display processor 310 (including display processor driver 330) may be any combination of hardware and software that executes or interprets instructions, data transactions, codes, or signals. For example, display processor 310 can be a microprocessor, an Application-Specific Integrated Circuit (ASIC), a distributed processor such as a cluster or network of processors or computing device, or a virtual machine.

Display processor driver 330 may be a software module residing in system memory 306 and in communication with display processor 310. Computing system 300 may communicate via the display interface 302 (e.g., to provide displayed signals representing data or information) with at least one display 320. Display 320 is to include a number of pixels that may be organized in columns, rows, and so on, to be addressed by the display processor 310/display processor driver 330 according to local neighborhoods. Display processor 310 may include hardware (e.g., pins, connectors, or integrated circuits) and software (e.g., drivers or communications stacks). For example, display processor 310 can communicate via traces to pins forming the display interface 302 such as a video graphics array (VGA), digital visual interface (DVI), high-definition multimedia interface (HDMI), DisplayPort, or other graphical interface.

Memory 306 is a processor-readable medium that stores instructions, codes, data, or other information. For example, memory 306 can be a volatile random access memory (RAM), a persistent or non-transitory data store such as a hard disk drive or a solid-state drive, or a combination thereof or other types of memories. Furthermore, memory 306 can be integrated with processor 304 and/or display processor 310, or separate therefrom, or external to computing system 300.

Operating system 308 and display processor driver 330 may be instructions or code that, when executed at processor 304 and/or display processor 310, cause processor 304 and/or display processor 310 to perform operations that implement features of operating system 308 and display processor driver 330. In other words, operating system 308 and display processor driver 330 may be hosted at or otherwise loaded onto computing device 300. More specifically, display processor driver 330 may include code or instructions that implement the features discussed above with reference to FIGS. 1 and 2, for example. Additionally, display processor driver 330 may include code or instructions that implement features discussed with reference to FIGS. 4-7.

In some implementations, display processor driver 330 (and/or other components as disclosed herein throughout) may be hosted or implemented at a computing device appliance. That is, the display processor driver 330 and/or other components may be implemented at a computing device 300 that is dedicated to hosting the display processor driver 330. For example, the display processor driver 330 can be hosted at a computing device with a minimal or "just-enough" operating system, and/or virtualized computing systems having virtualized displays. Furthermore, the display processor driver 330 may be a primary software application hosted at the appliance.

Figure 4:
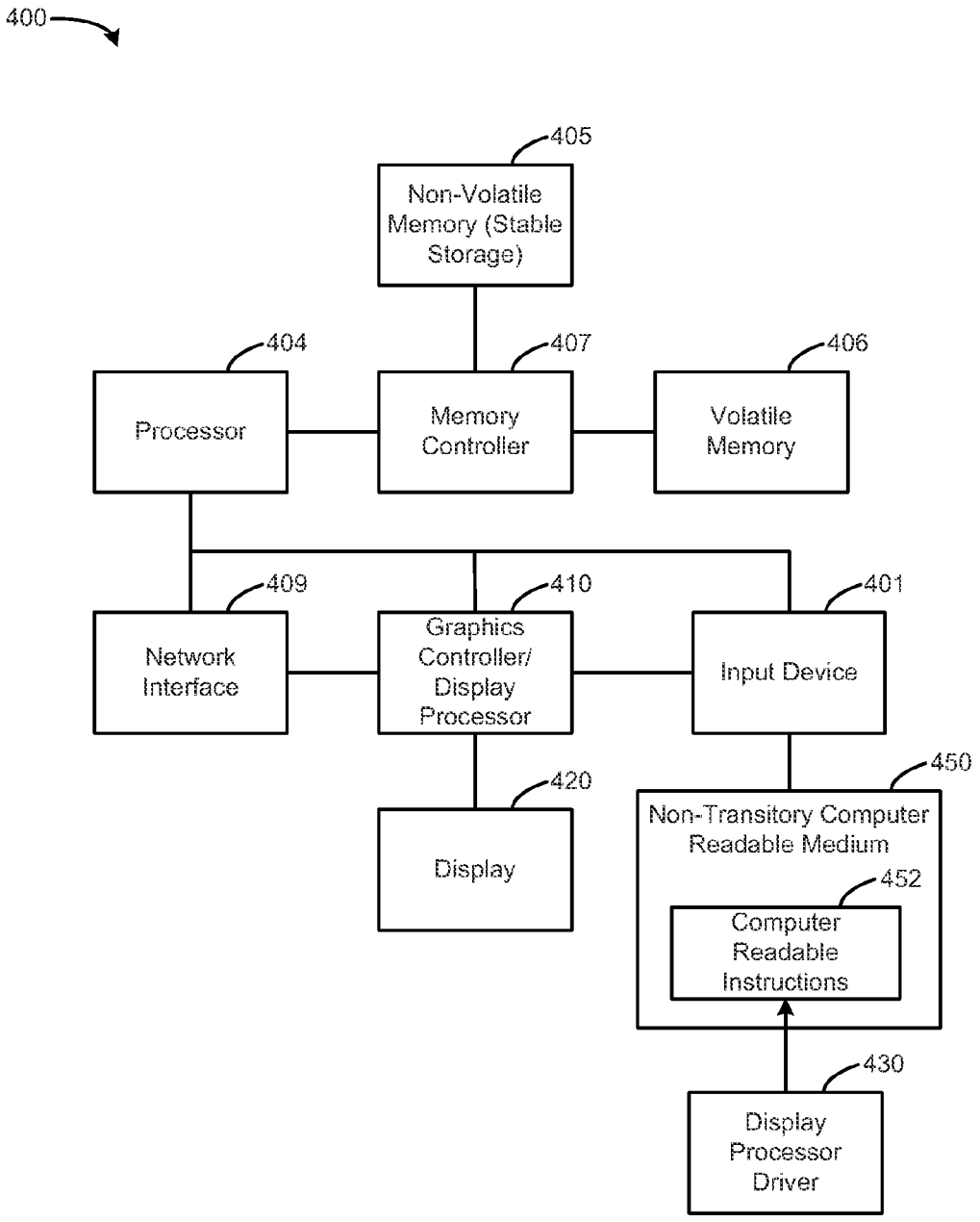
FIG. 4 is a block diagram of a computing system including a display processor and display processor driver according to an example.

FIG. 4 is a block diagram of a computing system 400 including a display processor 410 and display processor driver 430 according to an example, and may be implemented in hardware, software, or a combination of both. Computing system 400 may include a processor 404, display processor 410, and memory resources, such as, for example, the volatile memory 406 and/or the non-volatile memory 405, for executing instructions stored in a tangible non-transitory medium (e.g., volatile memory 406, non-volatile memory 405, and/or non-transitory computer readable medium 450). The non-transitory computer-readable medium 450 can have computer-readable instructions 452 stored thereon that are executed by the processor 404 and/or display processor 410 to implement display processor driver 430 according to the present examples.

A machine (e.g., computing system 400) may include and/or receive a tangible non-transitory computer-readable medium 450 storing a set of computer-readable instructions 452 (e.g., software) via an input device 401. As used herein, the processor 404 and/or the display processor 410 can include one or a plurality of processors such as in a parallel processing system. The memory 406 can include memory addressable by the processor 404 and/or display processor 410 for execution of computer readable instructions. The display processor 410 may include its own discrete display memory (e.g., graphics memory) that may be loaded with instructions, including display processor driver 430. The computer readable medium 450 can include volatile and/or non-volatile memory such as a random access memory (RAM), magnetic memory such as a hard disk, floppy disk, and/or tape memory, a solid state drive (SSD), flash memory, phase change memory, and so on that may be readable by the input device 401. In some embodiments, the non-volatile memory 405 can be a local or remote database including a plurality of physical non-volatile memory devices. Non-volatile memory 405 may include: a Parallel AT Attachment (PATA) interface, a Serial AT Attachment (SATA) interface, a Small Computer Systems Interface (SCSI) interface, a network (e.g., Ethernet, Fiber Channel, InfiniBand, Internet Small Computer Systems Interface (iSCSI), Storage Area Network (SAN), or Network File System (NFS)) interface, a Universal Serial Bus (USB) interface, or other storage device interfaces. Display processor 410 can also include other forms of memory, including non-volatile random-access-memory (NVRAM), battery-backed random-access memory (RAM), phase change memory, and so on.

The processor 404 can control the overall operation of the computing system 400. The processor 404 can be connected to a memory controller 407, which can read and/or write data from and/or to volatile memory 406 (e.g., random access memory (RAM)). The processor 404 can be connected to a bus to provide communication between the processor 404, the network interface 409, display processor 410, and other portions of the computing system 400. The non-volatile memory 405 can provide persistent data storage for the computing system 400. Further, the graphics controller 410 can connect to a display 420 that is capable of providing pixels addressable based on display colors to provide an apparent desired color (e.g., at a greater apparent color depth than the display 420 is capable of producing at a pixel).

A computing system 400 can include a computing device having control circuitry such as a processor, a state machine, ASIC, controller, and/or similar machine. As used herein, the indefinite articles "a" and/or "an" can indicate one or more than one of the named object. Thus, for example, "a processor" can include one or more than one processor, such as in a multi-core processor, cluster, or parallel processing arrangement.

The present disclosure is not intended to be limited to the examples shown herein, but is to be accorded the widest scope consistent with the principles and novel features disclosed herein. For example, it is appreciated that the present disclosure is not limited to a particular configuration, such as computing system 400. The various illustrative modules and steps described in connection with the examples disclosed herein may be implemented as electronic hardware, computer software, or combinations of both. Examples may be implemented using software modules, hardware modules or components, or a combination of software and hardware modules or components. Thus, in an example, one or more of the example steps and/or blocks described herein may comprise hardware modules or components. In another example, one or more of the steps and/or blocks described herein may comprise software code stored on a non-transitory computer readable storage medium, which is executable by a processor.

To clearly illustrate this interchangeability of hardware and software, various illustrative components, blocks, modules, and steps have been described generally in terms of their functionality (e.g., the display processor driver 430). Whether such functionality is implemented as hardware or software depends upon the particular application and design constraints chosen for the overall system. Those skilled in the art may implement the described functionality in varying ways for each particular application, but such implementation decisions should not be interpreted as causing a departure from the scope of the present disclosure.

Figure 5:
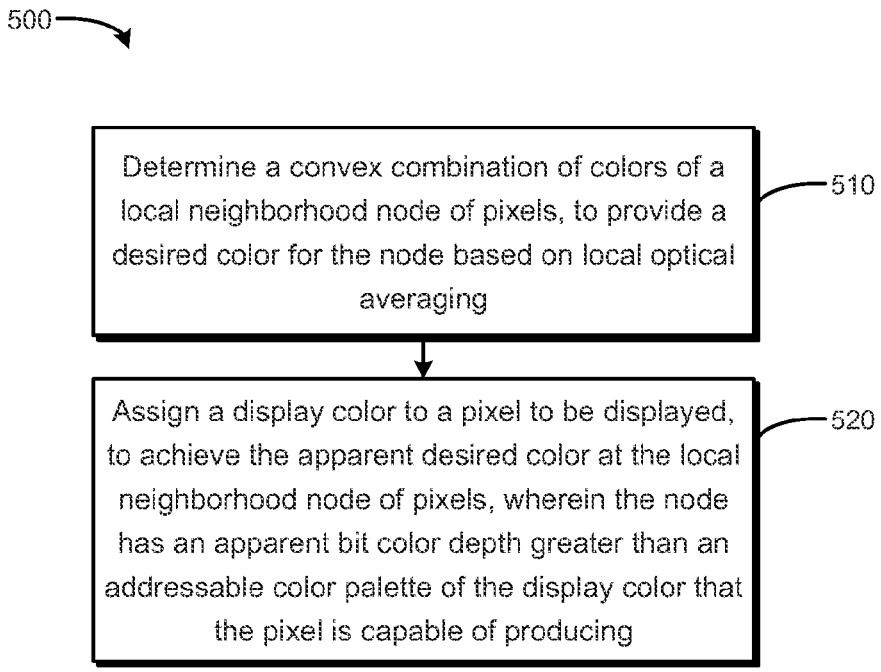
FIG. 5 is a flow chart based on achieving an apparent desired color according to an example.
Figure 6:
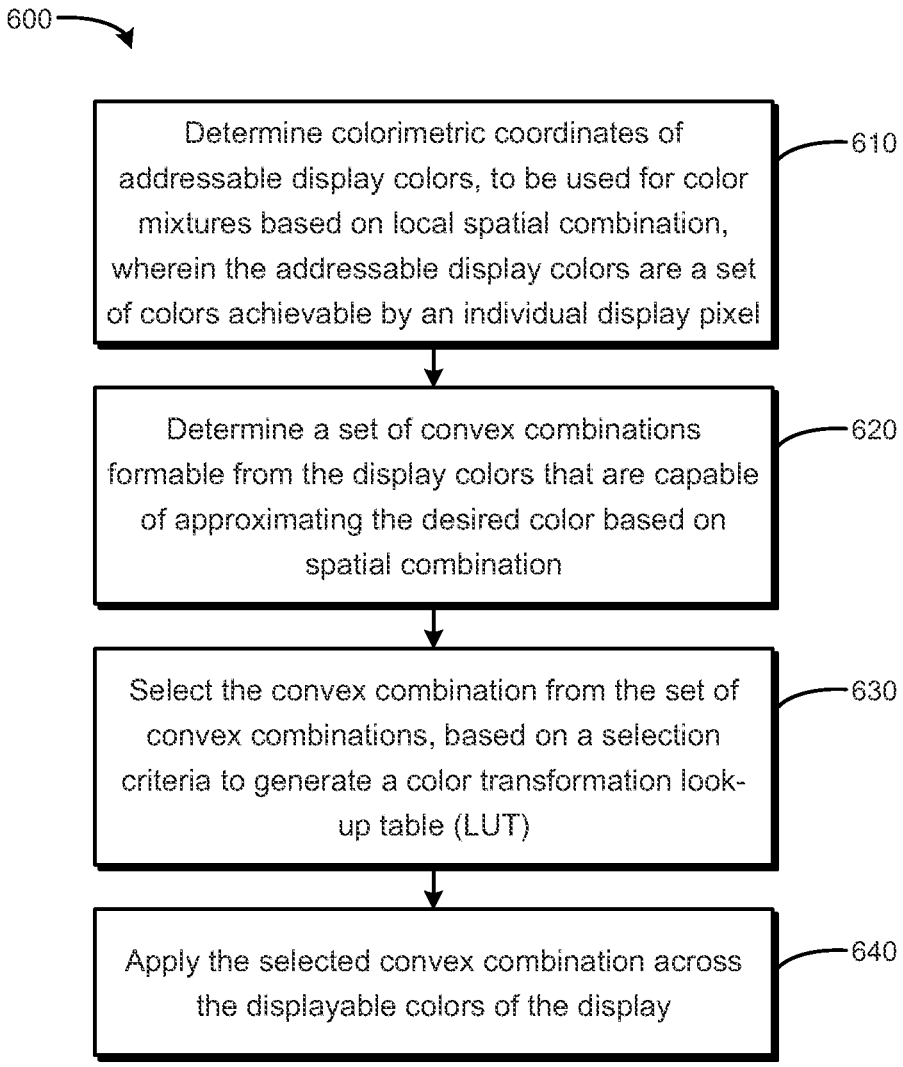
FIG. 6 is a flow chart based on applying convex combinations of displayable colors according to an example.
Figure 7:
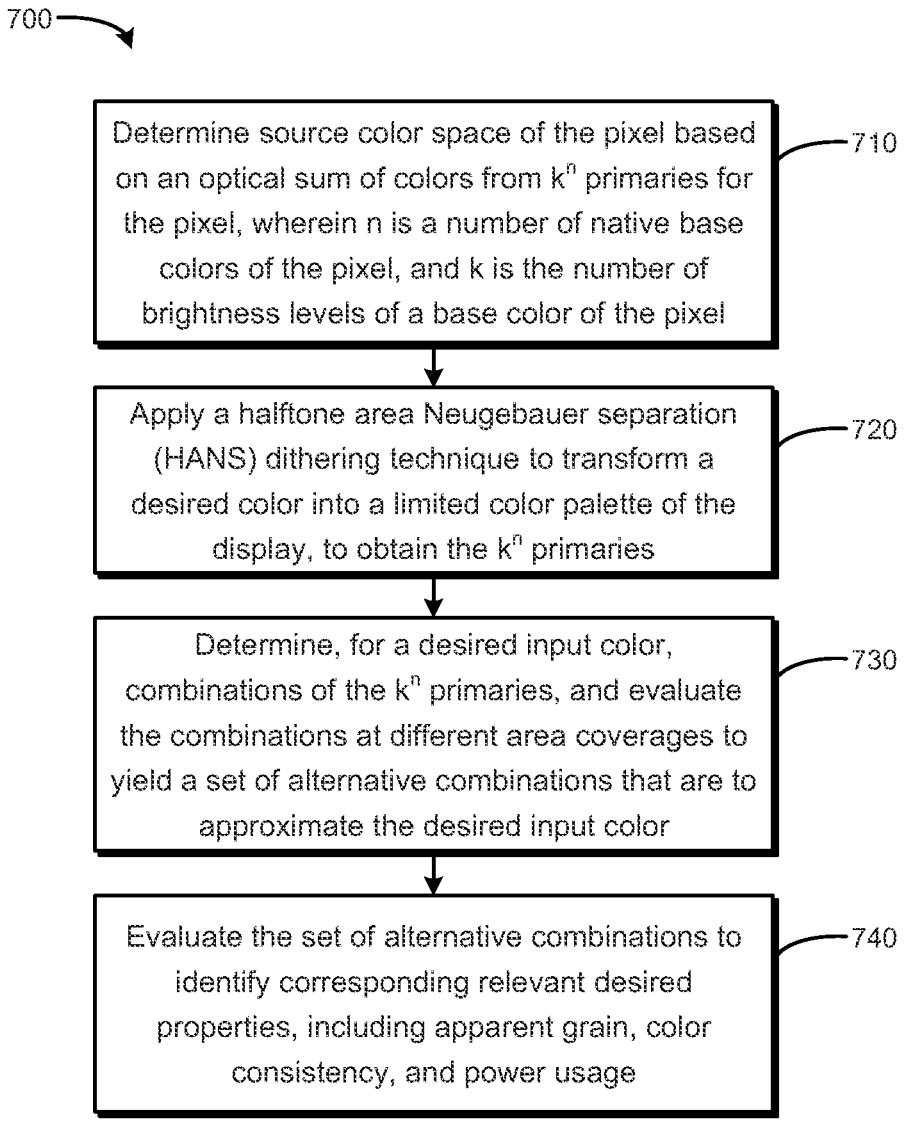
FIG. 7 is a flow chart based on applying halftone area Neugebauer separation (HANS) according to an example.

Referring to FIGS. 5-7, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 5 is a flow chart 500 based on achieving an apparent desired color according to an example. In block 510, a convex combination of colors of a local neighborhood node of pixels is determined, to provide a desired color for the node based on local optical averaging. For example, a display processor may identify display constraints and intended usage, and generate alternative combinations of display colors that may achieve the desired color at a local neighborhood node in view of the intended usage. The alternative combinations may be stored in a LUT for future reference. In an example, the characteristics of a display application may be determined in advance, and the display processor may be pre-programmed to include the LUT for that display, such that alternative combinations of colors may be available. In block 520, a display color is assigned to a pixel to be displayed, to achieve the apparent desired color at the local neighborhood node of pixels, wherein the node has an apparent color bit depth greater than an addressable color palette of the display color that the pixel is capable of producing. For example, the display processor may consider a larger or smaller local neighborhood node, and choose various alternate combinations accordingly to provide an apparent desired color output. Based on the difference between the apparent desired color and the assigned display color at a first pixel, the display processor may vary the display colors chosen for other pixels near the first pixel (e.g., in a neighborhood node), to distribute the difference and result in the overall appearance of the desired color based on the intended usage of the display.

FIG. 6 is a flow chart 600 based on applying convex combinations of displayable colors according to an example. In block 610, colorimetric coordinates of addressable display colors are determined, to be used for color mixtures based on local spatial combination, wherein the addressable display colors are a set of colors achievable by an individual display pixel. In block 620, a set of convex combinations are determined, formable from the display colors that are capable of approximating the desired color based on spatial combination. In block 630, the convex combination is selected from the set of convex combinations, based on a selection criteria to generate a color transformation look-up table (LUT). In block 640, the selected convex combination is applied across the displayable colors of the display, e.g., using the LUT.

In an example illustrating the blocks of FIG. 6, a display processor may determine the colorimetric coordinates of addressable display colors based on measuring CIE XYZ values for colorimetric coordinates that relate to the human visual system perceiving the colors that are addressable by the display. Specifically, if the display is a two-bit RGB display, it can give rise to eight colors (wherein each of its 3 RGB channels can be on or off, for $2^3=8$ total colors) at a single display pixel. The display processor may keep track of and measure these alternative available colors, the building blocks from which the display processor may assemble color mixtures based on local spatial combination to cause desired colors to arise when viewed under intended usage. Thus, a greater bit-depth display provides more example alternatives to choose from, and the example two-bit display is provided for simplicity. The display processor may provide improved color performance on display hardware that has a low bit depth, but typically enjoys low cost and high volume production for applications where cost is a major factor.

The display processor may take these available colors addressable at individual pixels, and use them as building blocks by choosing combinations of the colors for a sampling of all the possible inputs to the display system. Using this sampling of the input space set of colors available at the display, the display processor may find all of and/or a set of convex combinations that can be formed. Thus, the display processor may match each of the samples of the input color space against a desired color. For example, the display processor may find all combinations of a display's addressable colors that can be spatially and convexly combined to match a desired color, including addressable colors that are not similar to the desired color but may be combined for the apparent effect. Thus, for each sample desired color, the display processor may have a list of alternative ways to match that desired color. For example, the display processor may achieve a dark red by combining a bright displayable red with a displayable black, or by combining two dark displayable reds/blues/purples/greens, or using very different colors in obtaining this same overall apparent desired red when viewing the display.

The display processor may mix colors, e.g., mix three colors by adjusting the local area coverage of a color. For example, the display processor may cover half (50%) of some small local area node using a first color, 40% using a second color, and 10% using a third color, obtained using the techniques described above to obtain specifications for relative colors/patterns. The display processor may recognize that different relative combinations of colors/patterns may be used to arrive at a given input desired color. These alternatives may be stored by or otherwise known to the display processor, e.g., in a LUT. The display processor may select one of the alternatives, to specify each of the input components obtained earlier. The display processor may select these based on various criteria, including display constraints and intended usage (e.g., viewing distance). A constraint preference may be specified, such as preferences in view of whether there is a difference in power consumption for displaying alternative patterns use to arrive at a desired color, whether an alternative is more or less grainy than another, or other factors that may be taken into account. To illustrate, a display intended to be viewed at a closer distance may impose a need for a less-grainy appearance, because the graininess may be more noticeable by the HVS at closer distances. By contrast, a display to be viewed from a greater distance may be more tolerant to graininess, which is less apparent at greater distances (e.g., based on HVS models).

Thus, the display processor obtains a lookup table that, for a color (RGB etc.) input, specifies how to combine the addressable display colors to match a desired color. The display processor can apply the LUT using error diffusion. For example, for a given display neighborhood node, the first three addressable colors may be used at certain area coverages. At a first pixel, the display processor may use the first addressable color, incurring an error in all three components of this pattern. The error of the first pixel may then be propagated to its neighbors (e.g., using dithering techniques such as Floyd Steinberg or others to distribute the error). For example, in a local neighborhood node, a portion of the error may be distributed to a neighbor pixels horizontally, vertically, and diagonally according to error diffusion techniques or other techniques such as those based on a threshold matrix (to choose for each pixel that component of the pattern which is just above the threshold value for the corresponding pixel without having to do spatial operations, suitable to being processed in parallel).

FIG. 7 is a flow chart 700 based on applying halftone area Neugebauer separation (HANS) according to an example. In block 710, a source color space of the pixel is determined based on an optical sum of colors from $k^n$ primaries for the pixel, wherein n is a number of native base colors of the pixel, and k is the number of brightness levels of a base color of the pixel. For example, a display processor identifies what possible color combinations are available for building combinations to be used to display a desired color in a neighborhood node of a display. In block 720, a halftone area Neugebauer separation (HANS) dithering technique is applied to transform a desired color into a limited color palette of the display, to obtain the $k^n$ primaries. For example, the display processor may identify the primaries that may serve as building blocks to be combined for obtaining the desired color. In block 730, combinations of the $k^n$ primaries are determined for a desired input color, and the combinations are evaluated at different area coverages to yield a set of alternative combinations that are to approximate the desired input color. For example, a given desired color may be obtainable based on various different combinations, including similar colors and/or dissimilar colors. In block 740, the set of alternative combinations are evaluated to identify corresponding relevant desired properties, including apparent grain, color consistency, and power usage. For example, the display processor may choose a first alternative combination for a desired color on a first type of display used at a close viewing distance, and choose a second alternative combination for the desired color if displayed on a second type of display used at a far viewing distance.

Examples provided herein may be implemented in hardware, software, or a combination of both. Example systems can include a processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system (e.g., a computing device) can include and/or receive a tangible non-transitory computer-readable medium storing a set of computer-readable instructions (e.g., software). As used herein, the processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. A display system comprising:

a display interface to be coupled to a display; and a display processor coupled to the display interface to:

assign a display color to a pixel to be displayed, to achieve an apparent desired color at a local neighborhood node of pixels haying an apparent color bit depth greater than an addressable color palette for the display color that the pixel is capable of producing, wherein the display processor is to assign the display color to the pixel based on a convex combination of colors of the local neighborhood node of pixels, to provide the desired color for the node based on local optical averaging;

determine colorimetric coordinates of addressable display colors to be used for color mixtures based on local spatial combination, wherein the addressable display colors are a set of colors achievable by an individual display pixel;

determine a set of convex combinations formable from the display colors that are capable of approximating the desired color based on spatial combination:

select the convex combination from the set of convex combinations, based on a selection criteria to generate a color transformation look-up table (LUT); and apply the selected convex combination across the displayable colors of the display.

2. The display system of claim 1, wherein the display processor is to assign the display color to the pixel based on a color transformation look-up table (LUT) indexed in a source color space of the pixel that contains an addressable primary relative area coverage vector for the node.

3. A non-transitory machine-readable storage medium encoded with instructions executable by a computing system that, when executed, cause the computing system to:

determine a convex combination of colors of a local neighborhood node of pixels, to provide a desired color for the node based on local optical averaging;

assign a display color to a pixel to be displayed, to achieve the apparent desired color at the local neighborhood node of pixels, wherein the node has an apparent color bit depth greater than an addressable color palette of the display color that the pixel is capable of producing;

determine colorimetric coordinates of addressable display colors, to be used for color mixtures based on local spatial combination, wherein the addressable display colors are a set of colors achievable by an individual display pixel;

determine a set of convex combinations formable from the display colors that are capable of approximating the desired color based on spatial combination;

select the convex combination from the set of convex combinations, based on a selection criteria to generate a color transformation look-up table (LUT); and apply the selected convex combination across the displayable colors of the display.

4. The storage medium of claim 3, wherein the selection criteria corresponds to a characteristic of the convex combinations, including display power consumption, graininess, and appearance as a function of viewing distance.

5. The storage medium of claim 3. further comprising instructions that cause the computing system to apply the selected convex conibination based on distributing, a difference error, between the desired color and the displayable color of a pixel, across the surrounding pixels in the local neighborhood node.

6. The storage medium of claim 3, further comprising instructions that cause the computing system to assign the display color to the pixel based on a color transformation look-up table (LUT) indexed in a source color space of the pixel that contains an addressable primary relative area coverage vector for the node.

7. The storage medium of claim 6, wherein the source color space of the pixel is based on an optical sum of colors from $K^n$ primaries for the pixel, wherein n is a number of native base colors of the pixel, and k is the number of brightness levels of a base color of the pixel.

8. The storage medium of claim 7, further comprising instructions that cause the computing system to determine, for a desired input color, combinations of the $k^n$ primaries, and evaluate the combinations at different area coverages to yield a set of alternative combinations that are to approximate the desired input color.

9. The storage medium of claim 8, further comprising instructions that cause the computing system to evaluate the set of alternative combinations to identify corresponding relevant desired properties, including apparent grain, color consistency, and power usage.

10. The storage medium of claim 7, wherein the $k^n$ primaries are based on applying a halftone area Neugebauer separation (HANS) dithering, technique to transform a desired color into a limited color palette of the display.

11. The storage medium of claim 6, further comprising instructions that cause the computing system to apply the LUT using error diffusion.

12. The storage medium of claim 6. further comprising instructions that cause the computing system to apply the LUT using a threshold matrix.

13. The storage medium of claim 3, wherein the local optical averaging is based on a model of a human visual system (HVS).

14. A non-transitory machine-readable storage medium encoded with instructions executable by a computing system that, when executed, cause the computing system determine a convex combination of colors of a local neighborhood node of pixels, to provide a desired color for the node based on local optical averaging;

prepare a color transformation look-up table (LUT) indexed in a source color space of the pixel that contains an addressable primary relative area coverage vector for the node; and assign a display color to a pixel to be displayed based on the color transformation look-up table (LUT), to achieve the apparent desired color at the local neighborhood node of pixels, wherein the node has an apparent color bit depth greater than an addressable color palette of the display color that the pixel is capable of producing determine colorimetric coordinates of addressable display colors, to be used for color mixtures based on local spatial combination, wherein the addressable display colors are a set of colors achievable by an individual display pixel:

determine a set of convex combinations formable from the display colors that are capable of approximating the desired color based on spatial combination, select the convex combination from the set of convex combinations, based on a selection criteria to generate the color transformation LUT; and apply the selected convex combination across the displayable colors of the display.

* * * * *